US007824198B2

(12) United States Patent
Tanaka

(10) Patent No.: US 7,824,198 B2
(45) Date of Patent: Nov. 2, 2010

(54) CONNECTOR

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/583,504

(22) Filed: Aug. 21, 2009

(65) Prior Publication Data

US 2010/0048045 A1 Feb. 25, 2010

(30) Foreign Application Priority Data

Aug. 22, 2008 (JP) ..... 2008-213727

(51) Int. Cl.
*H01R 13/648* (2006.01)

(52) U.S. Cl. ..... 439/108; 439/497

(58) Field of Classification Search ..... 439/108, 439/497, 579, 660

See application file for complete search history.

(56) References Cited

U.S. PATENT DOCUMENTS

| | | | | |
|---|---|---|---|---|
| 4,605,276 | A * | 8/1986 | Hasircoglu | 439/465 |
| 4,826,443 | A * | 5/1989 | Lockard | 439/101 |
| 4,984,992 | A * | 1/1991 | Beamenderfer et al. | 439/108 |
| 5,415,567 | A | 5/1995 | Fusselman et al. | |
| 6,217,372 | B1 * | 4/2001 | Reed | 439/497 |
| 6,364,701 | B1 * | 4/2002 | O'Sullivan et al. | 439/579 |
| 6,489,563 | B1 * | 12/2002 | Zhao et al. | 174/88 C |
| 6,817,898 | B2 | 11/2004 | Tanaka et al. | |
| 6,935,870 | B2 | 8/2005 | Kato et al. | |
| 6,951,487 | B2 | 10/2005 | Ozai | |
| 7,223,121 | B2 * | 5/2007 | Moriyama et al. | 439/497 |
| 2003/0064625 | A1 * | 4/2003 | Ozai | 439/579 |

FOREIGN PATENT DOCUMENTS

| | | |
|---|---|---|
| JP | 08-509837 | 10/1996 |
| JP | 2001-015187 | 1/2001 |
| JP | 2002-270304 | 9/2002 |
| JP | 2002-334748 | 11/2002 |
| JP | 3-564556 | 4/2003 |
| JP | 2003-109708 | 4/2003 |
| JP | 2004-071231 | 3/2004 |
| JP | 2006-032208 | 2/2006 |
| JP | 2007-012588 | 1/2007 |
| JP | 2008-041656 | 2/2008 |

OTHER PUBLICATIONS

Japanese Office Action dated Jun. 10, 2010 with English translation of same.

* cited by examiner

*Primary Examiner*—Gary F. Paumen
(74) *Attorney, Agent, or Firm*—Collard & Rose, P.C.

(57) ABSTRACT

A connector configured to be connected with a cable including a drain line, comprises a plurality of ground contacts, a housing holding the ground contacts, and a ground plate connected with the ground contacts. The ground plate has a first surface and a second surface and provided with a drain connection portion. The first surface is configured so that the cable is mounted on the first surface. The second surface is a back of the first surface. The drain connection portion is configured to be connected with the drain line and being formed on the second surface.

9 Claims, 12 Drawing Sheets

CONNECTOR

CROSS REFERENCE TO RELATED APPLICATION

An applicant claims priority under 35 U.S.C. §119 of Japanese Patent Application No. 2008-213727 filed Aug. 22, 2008.

BACKGROUND OF THE INVENTION

This invention relates to an connector which comprises a plurality of ground contacts and a ground plate connected with the ground contacts.

For example, a connector of the above-mentioned type is disclosed in JP-B 3564556, which is incorporated herein by reference in its entirety. The disclosed connector is configured to be connected with a cable and comprises a ground contact and a ground plate. The ground plate is connected with the ground contact. The cable is held by the ground plate.

However, the disclosed connector can not match an impedance of the cable with another impedance of the connector suitably.

SUMMARY OF THE INVENTION

An aspect of the present invention provides a connector configured to be connected with a cable including a drain line. The connector comprises a plurality of ground contacts; a housing holding the ground contacts; and a ground plate connected with the ground contacts. The ground plate has a first surface and a second surface and provided with a drain connection portion. The first surface is configured so that the cable is mounted on the first surface. The second surface is a back of the first surface. The drain connection portion is configured to be connected with the drain line and being formed on the second surface.

An appreciation of the objectives of the present invention and a more complete understanding of its structure may be had by studying the following description of the preferred embodiment and by referring to the accompanying drawings.

Figure 1:
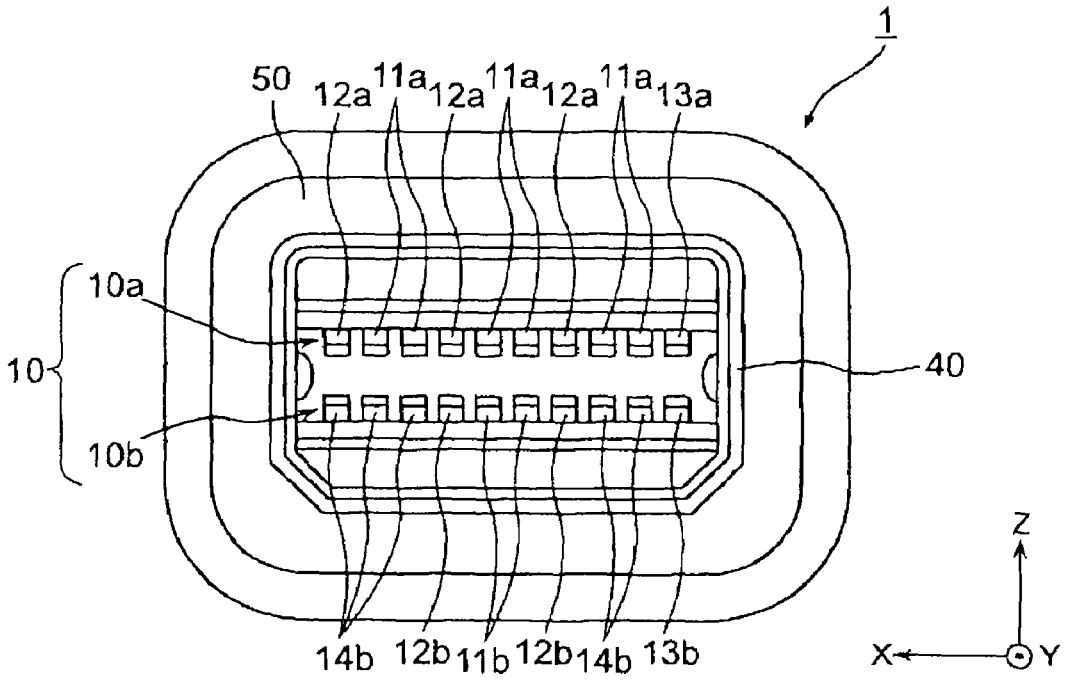
FIG. 1 is a front view of a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF THE PREFERRED EMBODIMENTS

Figure 2:
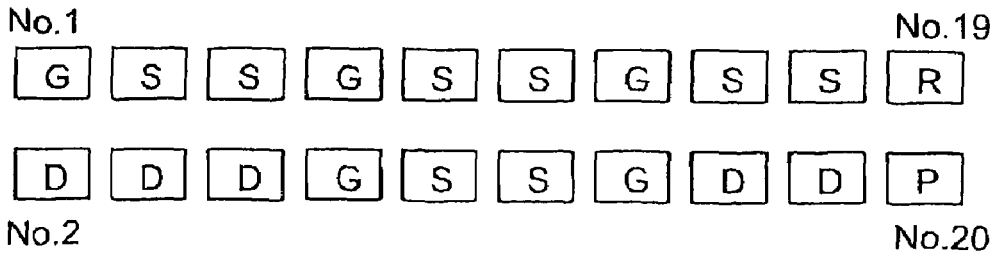
FIG. 2 shows an arrangement of contacts of the connector of FIG. 1, when viewed from the front of the connector.
Figure 9:
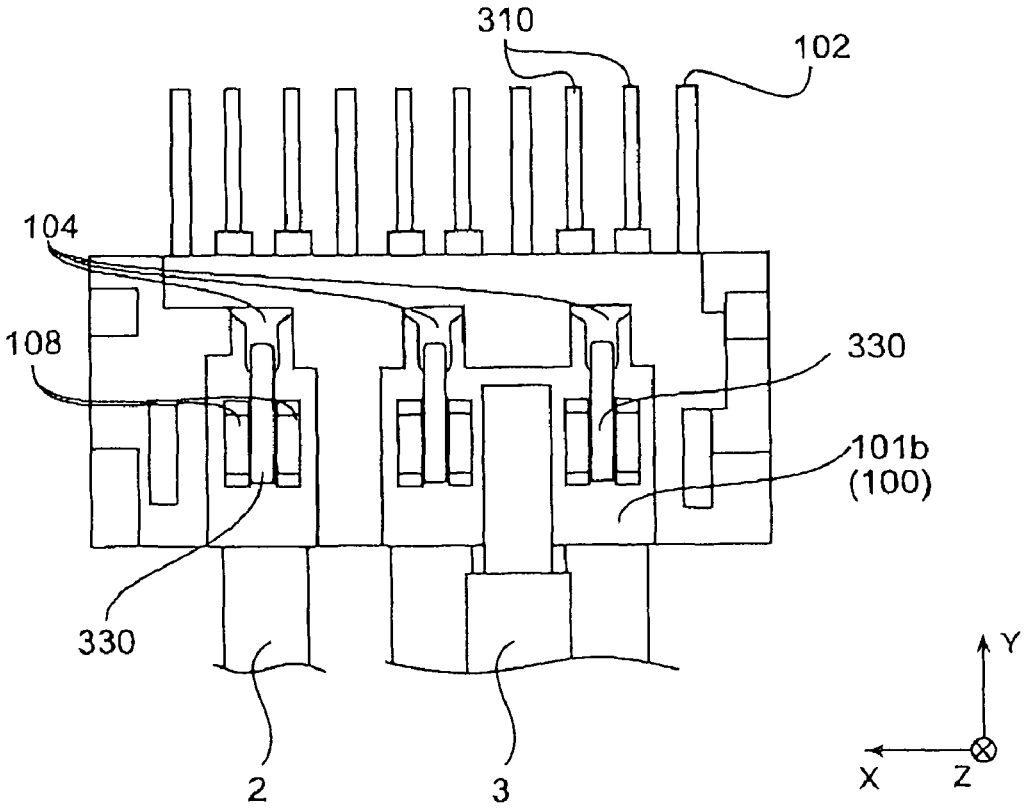
FIG. 9 is a bottom plan view of the state of FIG. 7.
Figure 16:
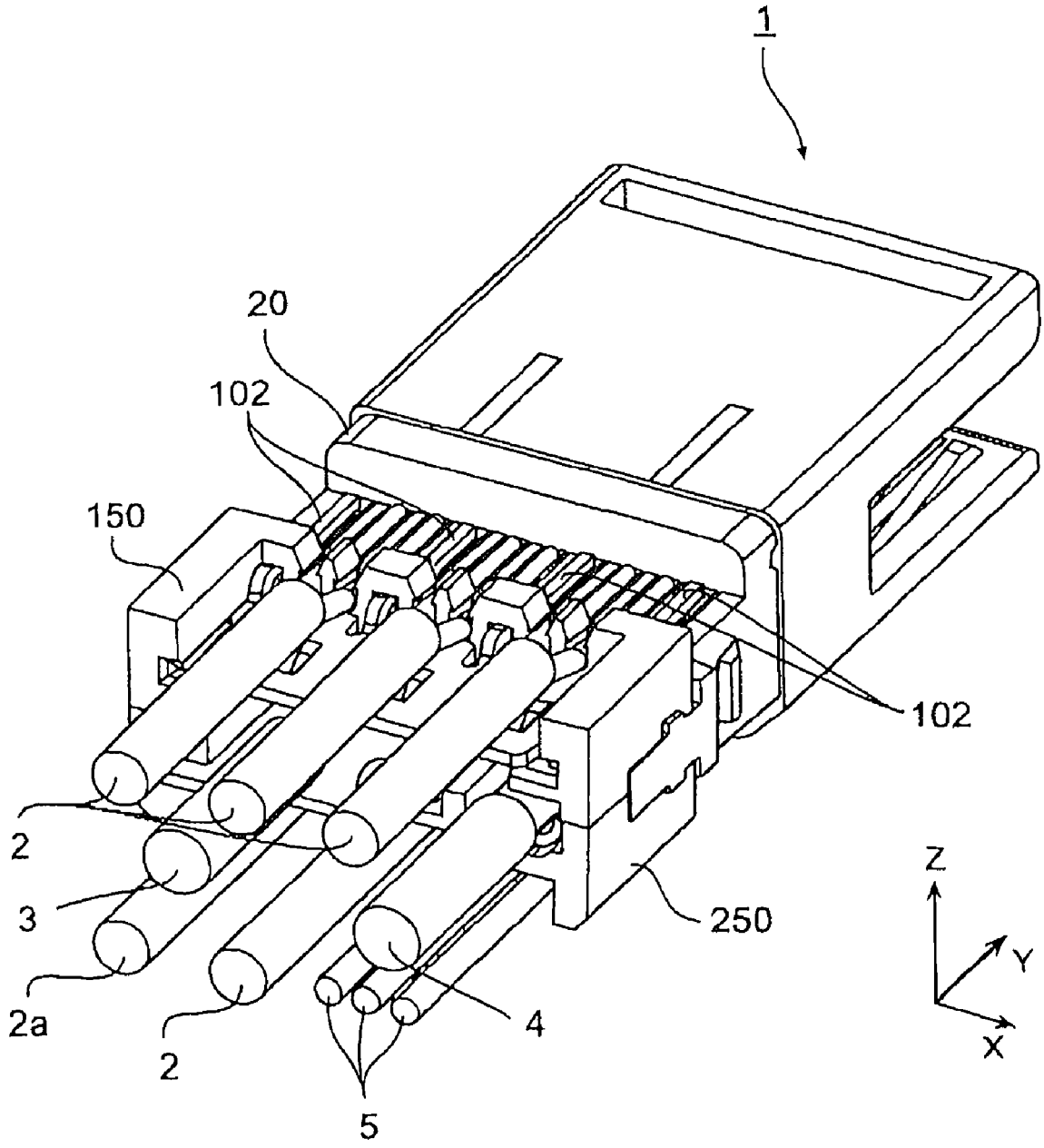
FIG. 16 is a perspective view of the connector of FIG. 15, wherein the cables are connected with the connector.

With reference to FIGS. 1, 2 and 16, a connector 1 according to an embodiment of the present invention connects cables to a mating port (not shown). For example, the mating port is a display port that is standardized by VESA (Video Electronics Standards Association) and includes a power return terminal (DP_PWR) and a power supply terminal (DP-_PWR). The connector 1 comprises twenty contacts 10 which correspond to twenty terminals of the port, respectively. The connector 1 of the present embodiment is configured to connect differential transmission cables 2, 2*a* (referred as simply "cable 2" or "cable 2*a*", hereinafter), a power return cable 3, a power supply cable 4 and single-ended transmission cable (referred as simply "cable 5", hereinafter) to the port. As shown in FIGS. 7, 9, 12 and 13, each of the cables 2 comprises a pair of signal cables 300 and a drain line 330, wherein each of the signal cables 300 includes a signal lines 310 used for high-speed signal, while the drain line 330 is to be grounded. As shown in FIG. 9, the power return cable 3 comprises a power return line. The power return line is a large-diameter line which has a diameter larger than that of the signal line 310. As shown in FIG. 13, the power supply cable 4 comprises a power supply line which has a diameter same as the power return line. Each of the cables 5 comprises a signal line 51 which is used for low-speed signal.

Figure 3:
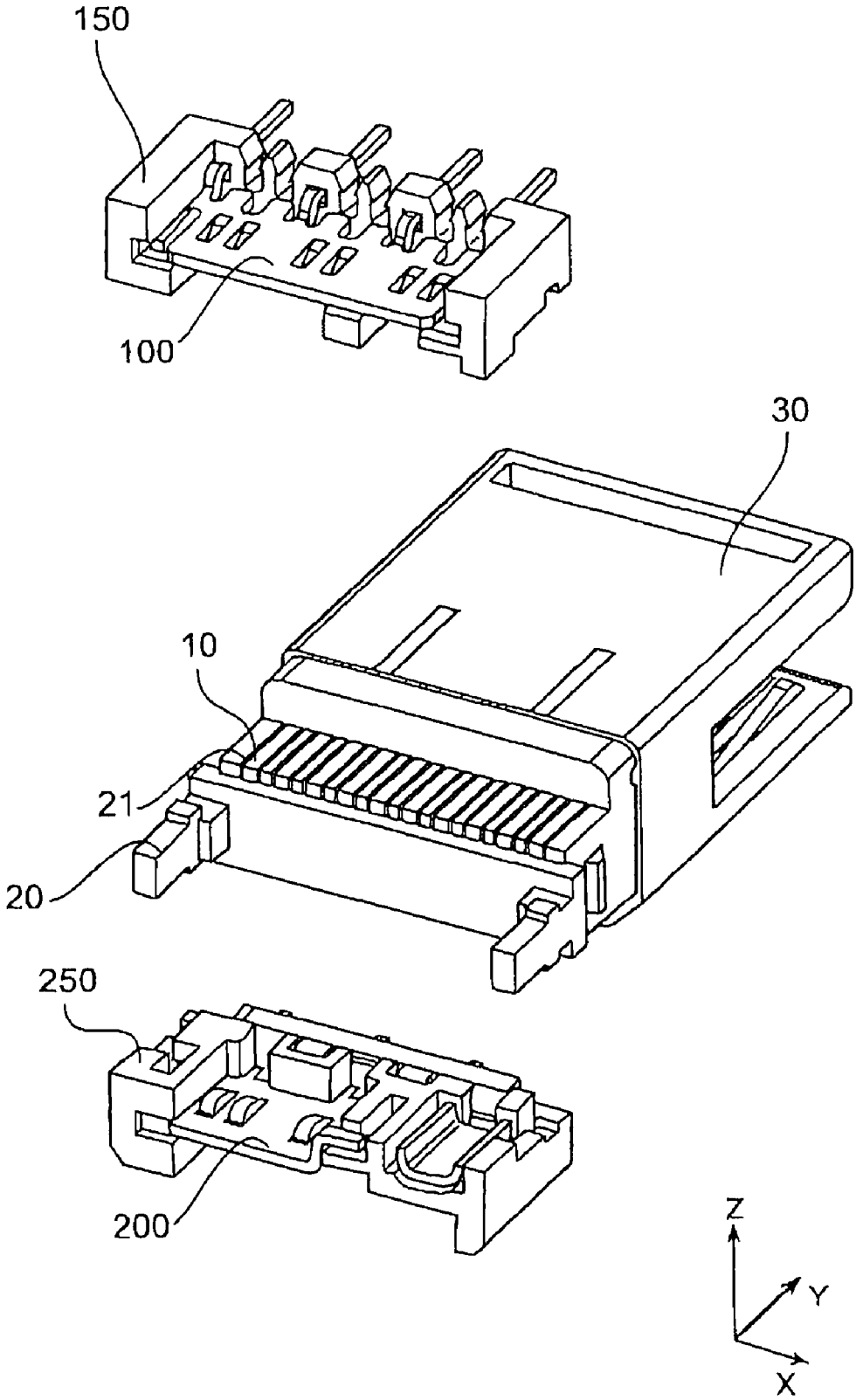
FIG. 3 is an exploded, perspective view of the connector of FIG. 1, wherein a shell and a hood are not shown.

With reference to FIGS. 1, 2 and 3, the connector 1 comprises first contact row 10*a* and a second contact row 10*b*, a locator 20, a housing 30, a shell 40 and a hood 50 (The shell 40 and the food 50 are shown only in FIG. 1). Each of the first contact row 10*a* and the second contact row 10*b* consists of ten contacts, as described in detail afterwards. The housing 30 is made of insulator and holds the first contact row 10*a* and the second contact row 10*b*. The locator 20 is made of insulator and is attached to the housing 30. The shell 40 is made of metal and covers the locator 20 and the housing 30. The hood 50 is configured to protect connections of the contacts 10 with the cables 2 and so on. The hood 50 of the present embodiment is not disposed at a front part of the connector 1 but is disposed only at a rear part of the connector 1.

Figure 7:
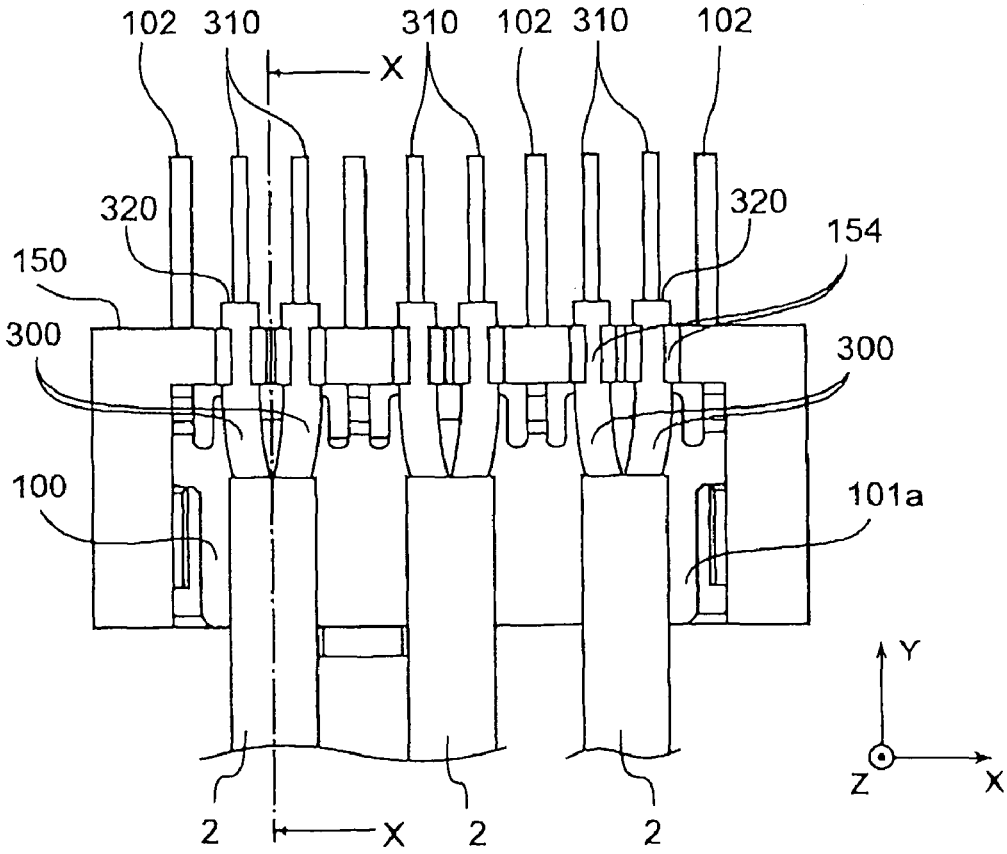
FIG. 7 is a top plan view of the state where cables are held by the first ground plate and the first holder.

With reference to FIGS. 1, 2 and 7, the first contact row 10*a* comprises three ground contacts 12*a*, three pairs of signal contacts 11*a* and a ground contact 13*a*. The signal contacts 12*a* are used for high-speed signal transmission such as differential transmission. The ground contact 13*a* of the present embodiment is also used as a power return contact which is to be connected to the power return terminal (DP_PWR Return) of the mating port.

Figure 12:
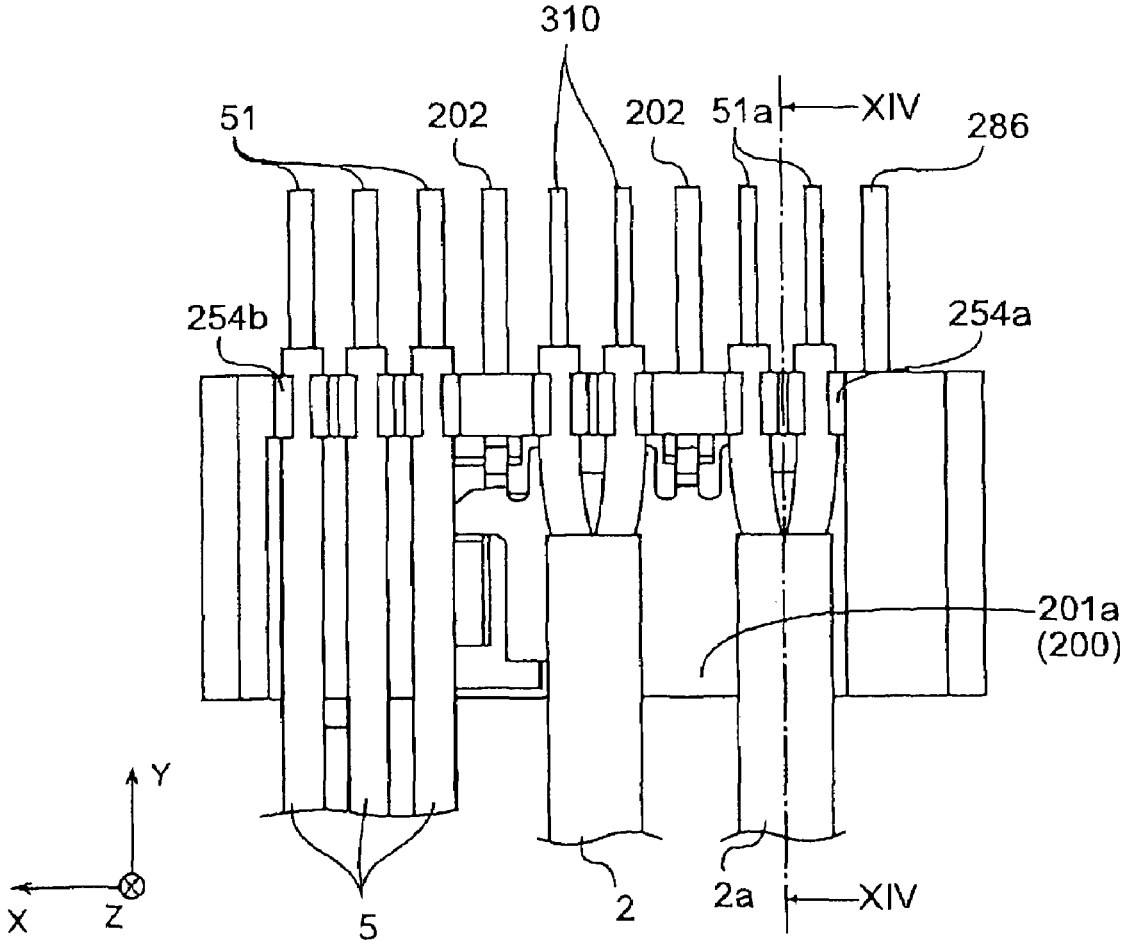
FIG. 12 is a plan view of the state where cables are held by the second ground plate and the second holder.
Figure 13:
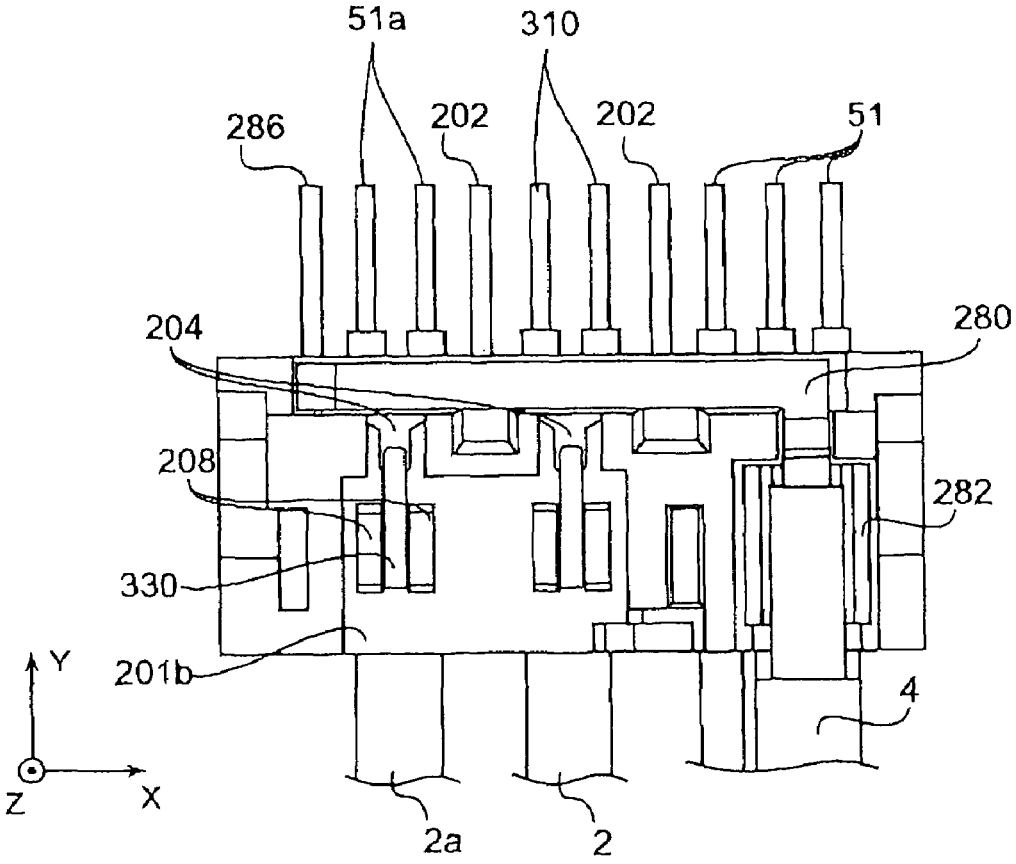
FIG. 13 is a bottom plan view of the state of FIG. 12.

With reference to FIGS. 1, 2 and 12, the second contact row 10*b* comprises two ground contacts 12*b*, a pair of signal contacts 11*b*, a power supply contact 13*b* and five signal contacts 14*b*. The signal contacts 11*b* is used for the high-speed transmission. The power supply contact 13*b* is to be connected to the power supply terminal (DP_PWR) of the mating port The signal contacts 14*b* are used for low-speed transmission such as single-ended transmission.

The first contact row 10*a* and the second contact row 10*b* are arranged as shown in FIG. 2, so that the first contact row 10*a* and the second contact row 10*b* correspond to each other in a height direction (a Z-direction). In FIG. 2, a symbol "G" represents the ground contact 12*a* or the ground contact 12*b*, a symbol "S" represents the signal contact 11*a* or the signal contact 11*b*, the symbol "P" represents the power supply contact 13*b*, a symbol "R" represents the ground contact 13*a*, and symbol "D" represents the signal contact 14*b*. As apparent from FIG. 2, the ground contact 13*a* and the power supply contact 13*b* correspond to No. 19 terminal and No. 20 terminal of the mating port, i.e. the power return terminal (DP_PWR Return) and the power supply terminal (DP_PWR). The ground contact 13*a* is positioned just above the power supply contact 13*b*. In addition, each pair of the signal contacts 11*a* is positioned between two of the ground contacts 12*a* closest to each other in a width direction (an X-direction) or between the ground contact 13*a* and the ground contact 12*a* closest thereto among the ground contacts 12*a*. In other words, each pair of the signal contacts 11*a* is positioned between neighboring ones of the ground contacts 12*a* or the ground contact 12*a* and the ground contact 13*a*. Thus, every pair of the signal contacts 11*a* is electrically shielded by the ground contacts 12*a* and the ground contact 13*a*. Likewise, a pair of the signal contacts 11*b* is positioned between the ground contacts 12*b*. In other words, the pair of the signal contacts 11*b* is positioned between neighboring ones of the ground contacts 12*b*, so that the pair of the signal contacts 11*b* is electrically shielded by the ground contacts 12*b*.

With reference to FIG. 3, the connector 1 of the present embodiment further comprises a first ground plate 100, a second ground plate 200, a first holder 150 and a second holder 250. The first ground plate 100 and the second ground plate 200 are held by the first holder 150 and the second holder 250, respectively.

Figure 4:
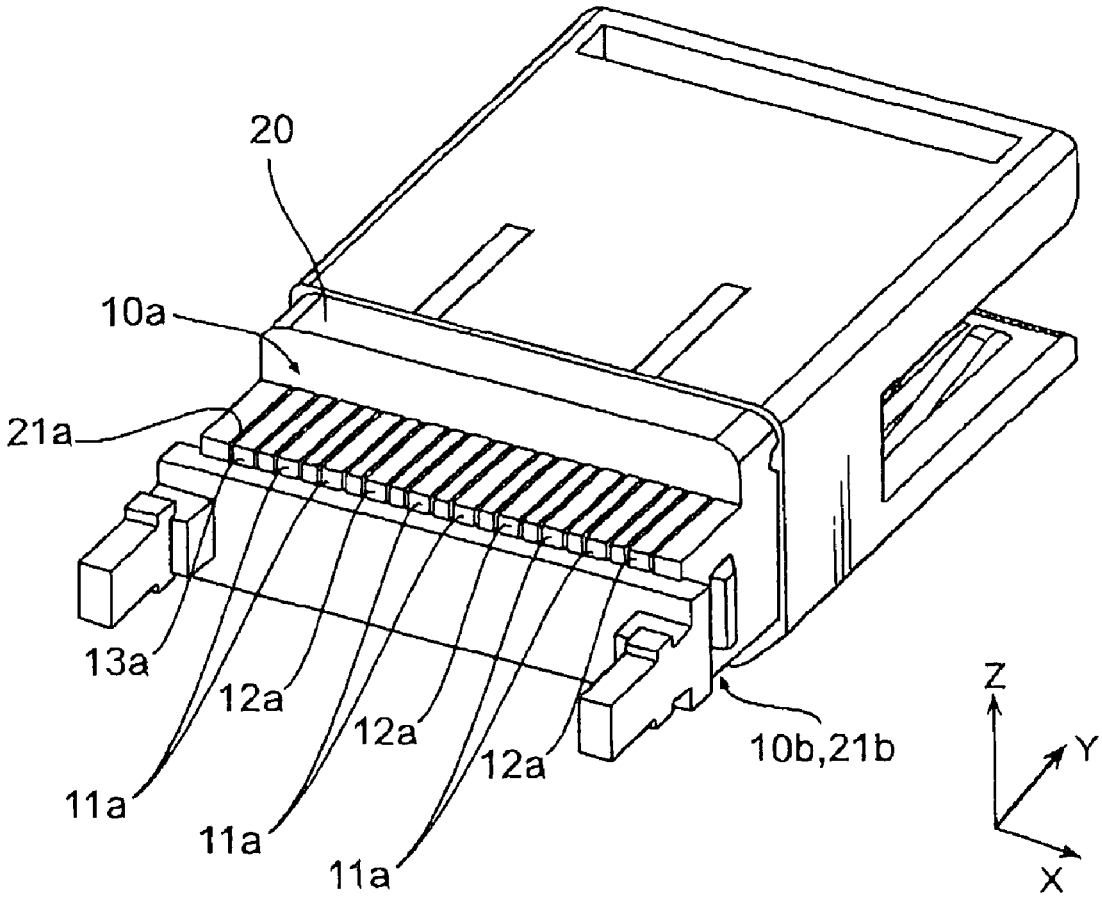
FIG. 4 is a perspective view of a locator and a housing of the connector of FIG. 3.

The locator 20 comprises twenty locating hollows 21. The locator 20 locates the contacts 10 in the X-direction so that the contacts 10 are positioned in the locating hollows 21, respectively. In detail, with reference to FIGS. 3 and 4, the locating hollows 21 are divided into two groups, i.e. first locating hollows 21*a* and second locating hollows 21*b*. The first locating hollows 21*a* locate the respective contacts belonging to the first contact row 10*a*, while the second locating hollows 21*b* locate the respective contacts belonging to the second contact row 10*b*. In FIGS. 3 and 4, the second contact row 10*b* and the second locating hollows 21*b* are hidden. With this structure, the contacts 10 can not be deformed and short-circuited each other.

Figure 5:
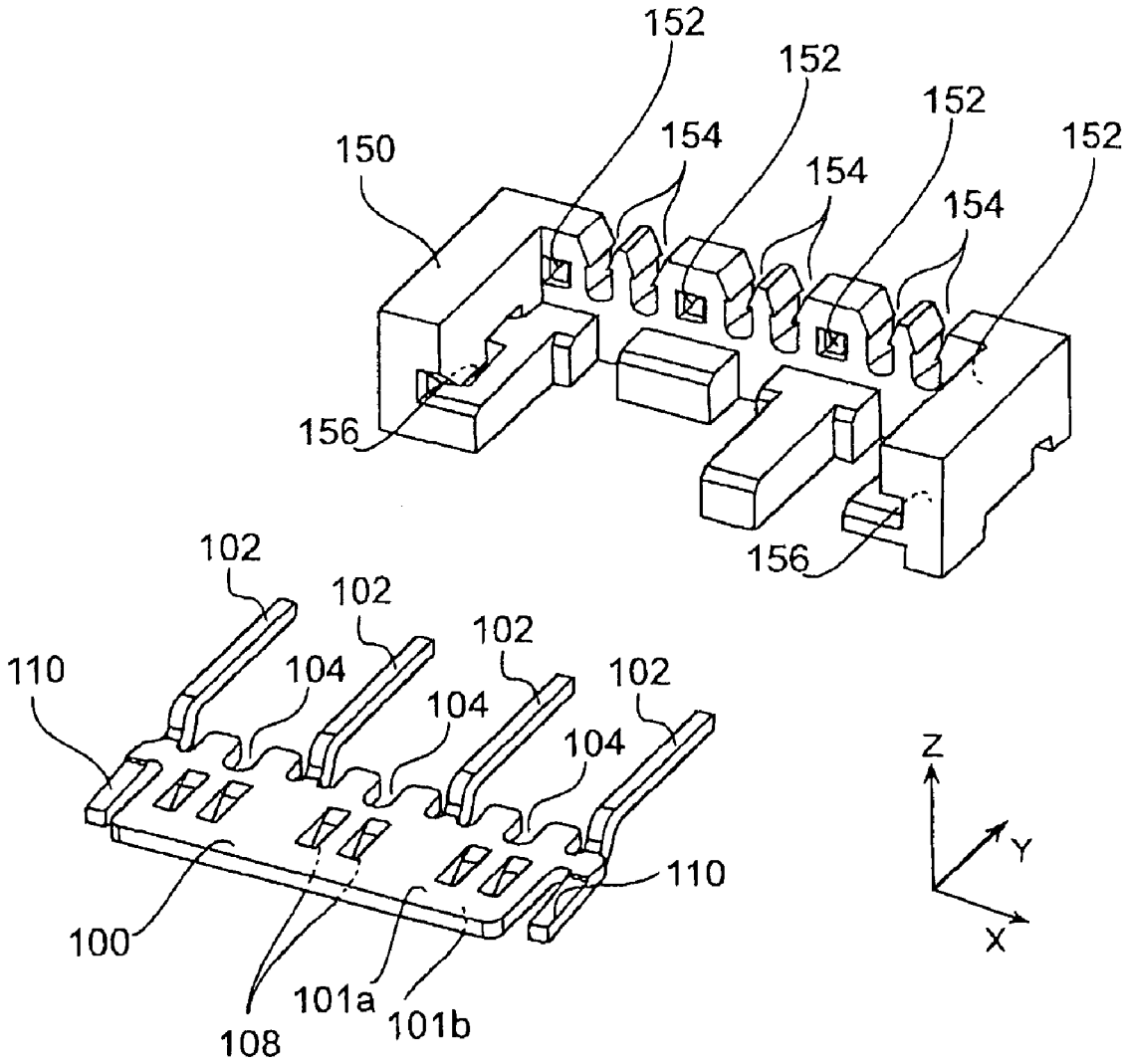
FIG. 5 is a perspective view of a first ground plate and a first holder of the connector of FIG. 3.

With reference to FIG. 5, the first ground plate 100 has a first surface 101*a* and a second surface 101*b*. As shown in FIG. 5, the second surface 101*b* is a back of the first surface 101*a*. The ground plate 100 comprises four contact portions 102, three notches 104, three pairs of projections 108 and two engagement portions 110. The contact portions 102 projects and extends forward, i.e. along a Y-direction. The notches 104 are formed on a front edge of the ground plate 100. The projections 108 are formed on the second surface 101*b* and project downward in the Z-direction. The engagement portions 110 extend backward in the Y-direction and downward in the Z-direction.

Figure 6:
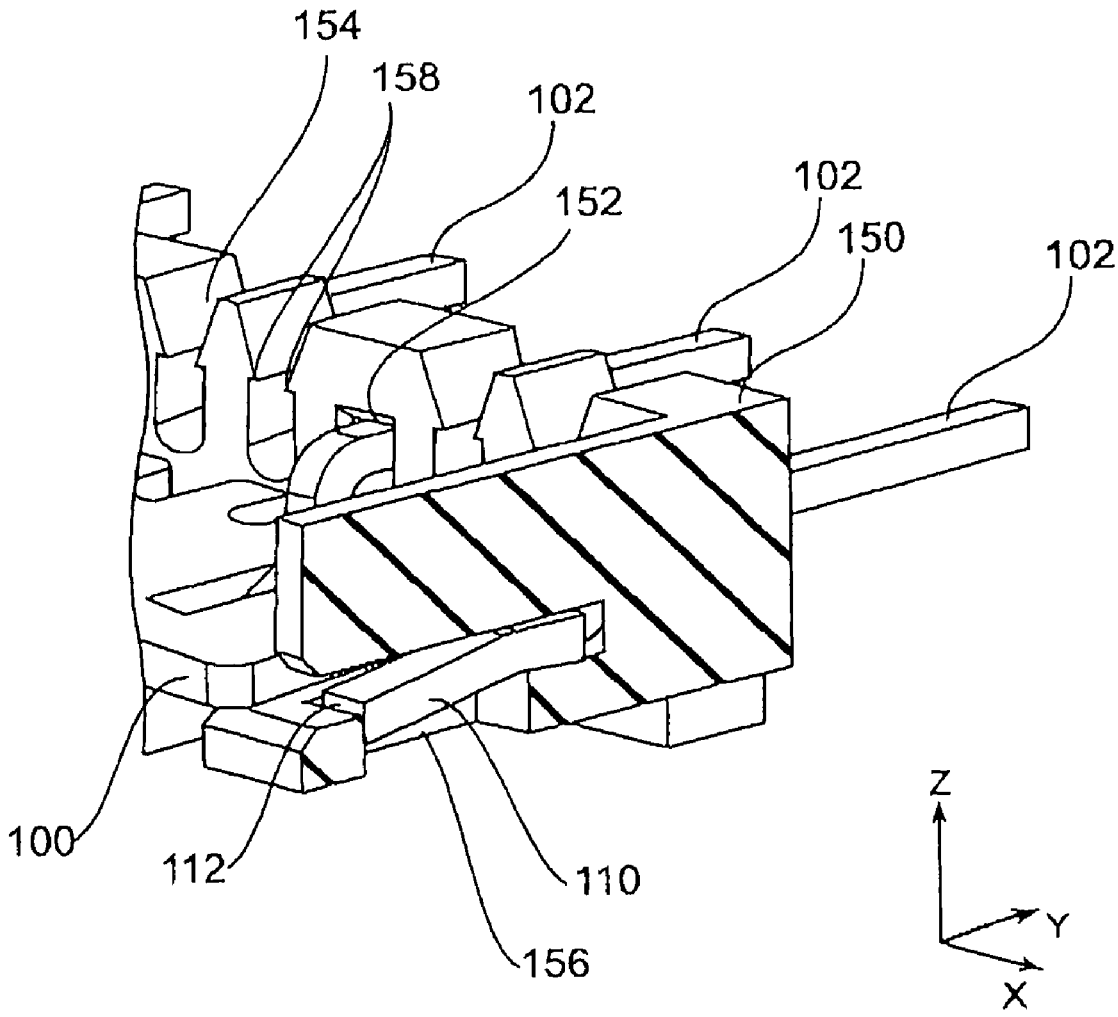
FIG. 6 is a perspective view showing a part of the state where the first ground plate is held by the first holder, especially showing an engagement portion and an engaged hole, wherein the first ground plate and the first holder are partially cut off.

The first holder 150 comprises four holes 152, three pairs of hold portions 154 and two engaged holes 156. Each pair of the hold portions 154 is positioned between two of the holes 152 closest to each other in the X-direction. Each of the hold portions 154 has U-shaped hollow and comprises a pair of barbs 158, as shown in FIG. 6. With reference to FIGS. 5 and 6, the first holder 150 holds the ground plate 100 so that the contact portions 102 of the ground plate 100 are inserted into the holes 152, respectively. In a state shown in FIG. 6, the engagement portion 110 is positioned in the hole 156 so that an end 112 of the engagement portion 110 is brought into contact with an inner surface of the hole 156. With this structure, the first ground plate 100 is prevented from being detached from the first holder 150.

Figure 8:
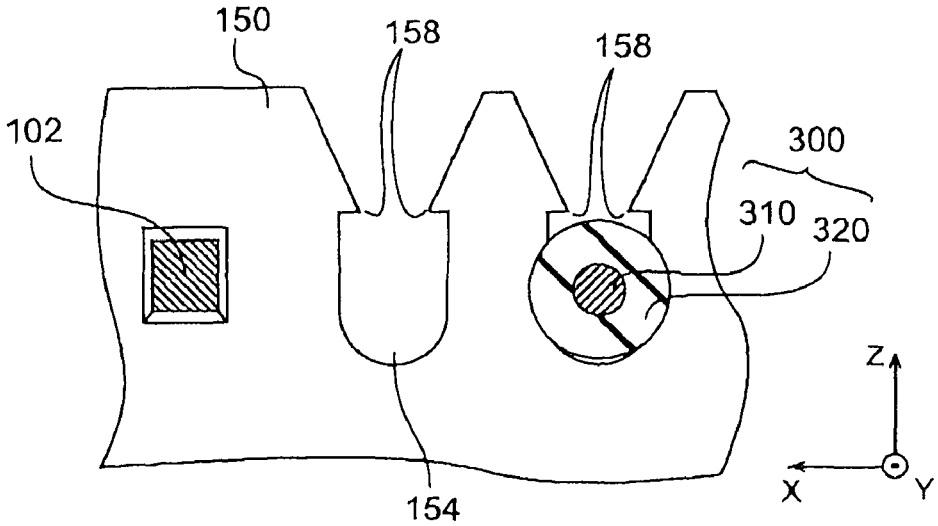
FIG. 8 is a partial, enlarged view of a hold portion of the first holder when viewed from the front of the first holder of FIG. 7.

With reference to FIGS. 7 and 8, the cables 2 are mounted on the first surface 101*a* of the first ground plate 100. As shown in FIG. 7, each of the signal cables 300 further comprises an inner sheath 320 which is made of an insulator and covers the signal line 310. A pair of the signal cables 300 is held by a corresponding pair of hold portions 154 of the first holder 150 so that each of the signal lines 310 is directed forwardly in the Y-direction. With reference to FIG. 8, the barbs 158 of each hold portion 154 keep the signal cable 300 in the hold portion 154. In FIG. 8, one of the signal cables 300 is not shown. As explained above, the first holder 150 is made of the insulator so that an electrical short-circuit between the signal lines 310 is prevented even if the inner sheath 320 is damaged when the signal cable 300 is pushed into the hold portion 154.

Figure 10:
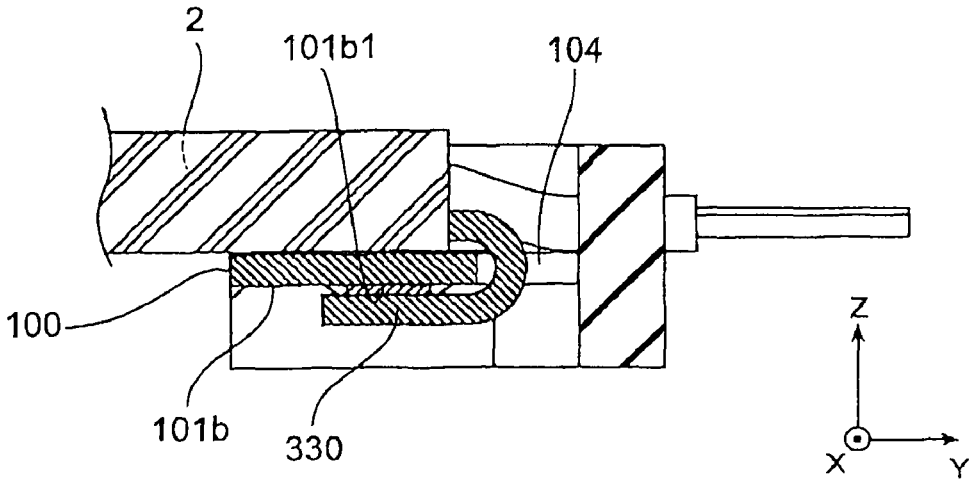
FIG. 10 is a cross-sectional view of the state of FIG. 7, taken along lines X-X, wherein a drain line of the cable is connected with a drain connection portion.

With reference to FIGS. 9 and 10, a drain connection portion (a first drain connection portion) 101*b*1 is formed on the second surface 101*b* of the first ground plate 100 and is positioned between a pair of projections 108 in the X-direction. The drain line 330 is routed from the cable 2 to the drain connection portion 101*b*1 through the notch 104. As shown in FIG. 10, the drain line 330 is connected with the drain connection portion 101*b*1 by soldering. The pair of projections 108 locates the drain line 330 on the corresponding drain connection portion 101*b*1. With reference to FIGS. 1 to 3, 9 and 16, the drain line 330 is connected with the ground contact 12*a* or the ground contact 13*a* through the contact portion 102. As shown in FIGS. 7 and 9, the drain line 330 is positioned under the cable 2 in the Z-direction and is positioned between a pair of the signal lines 310 in the X-direction. In other words, the signal lines 310 are located to be symmetric with respect to the drain line 330 in the X-direction. Because of the symmetrical arrangement, for each pair of the signal lines 310, a distance between the drain line 330 and one of the signal lines 310 is equal to a distance between the drain line 330 and the other signal line 310. As the result, an impedance of the cable 2 is suitably matched with another impedance of the connector suitably. In addition, the drain connection portion 101*b*1, i.e. the connection between the drain line 330 and the first ground plate 100 is not positioned on the same surface on which the signal cable 300 is positioned. In other words, the signal cable 300 and the drain connection portion 101*b*1 are positioned on different surfaces, i.e. the first surface 101*a* and the second surface 101*b*. The position of the drain connection portion 101*b*1 makes a size of the connector of this embodiment smaller in comparison with the conventional connector.

With reference to FIG. 9, the power return cable 3 is connected with the second surface 101*b* of the first ground plate 100. The power return cable 3 is connected with the ground contact 13*a* (See FIG. 1), not in directly, but through the contact portion 102 of the first ground plate 100.

Figure 11:
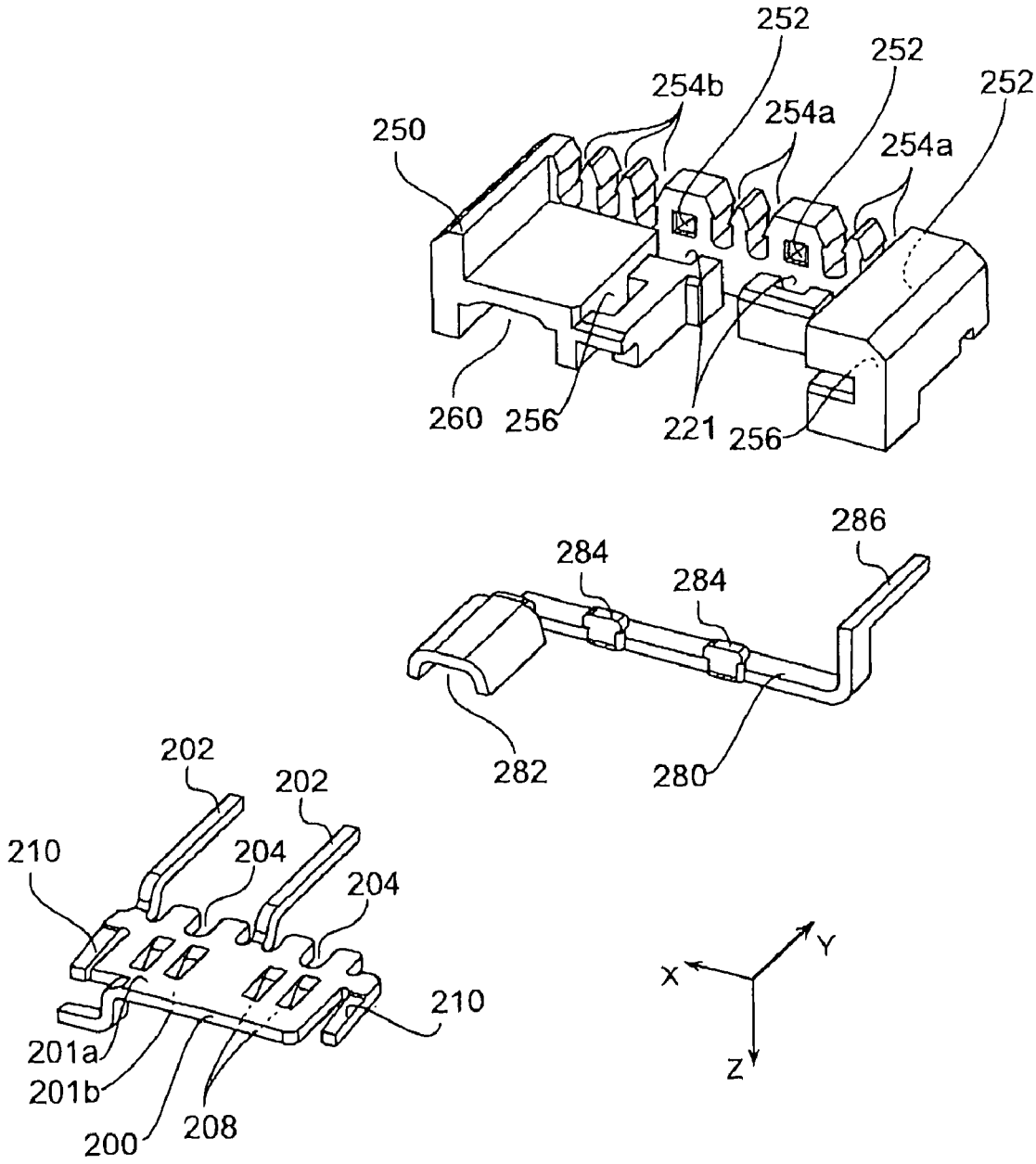
FIG. 11 is an exploded perspective view of a second ground plate, a second holder and a power-line plate of the connector of FIG. 3.

With reference to FIG. 11, the second holder 250 holds the second ground plate 200 and a connection member 280. The second ground plate 200 and the second holder 250 are similar to the first ground plate 100 and the first holder 150, respectively. In FIGS. 11 to 14, the same names are given to the components same as those illustrated in FIGS. 5 to 10, and the description therefor will be omitted. The second ground plate 200 comprises two contact portions 202, two notches 204, two pairs of projections 208 and two engagement portions 210.

The second holder 250 comprises three holes 252, two pairs of hold portions 254*a*, three hold portions 254*b* and two engaged holes 256. In this embodiment, each of the hold portions 254*a* is positioned between the holes 252 in the X-direction.

The second holder 250 further comprises two press-fit portions 221 and hold portion 260. The connection member 280 comprises a connection portion 282, two press-fitted portions 284 and a contact portion 286. To the connection portion 282, the power supply line of the power supply cable 4 is connected.

With reference to FIGS. 11 and 12, the second ground plate 200 has a first surface 201*a* and a second surface 201*b*. The cables 2, 2*a* and the cables 5 are mounted on the first surface 201*a* of the second ground plate 200 and are held by the hold portions 254*a* and hold portions 254*b*, respectively. As understood from FIGS. 1, 2 and 12, the cable 2*a* is a differential transmission cable but is used for low-speed transmission. Specifically, the cable 2*a* comprises a pair of signal lines 51*a* in addition to the drain line 330. The signal lines 51*a* of the cable 2*a* are connected with corresponding terminals No. 16 and No. 18 of the mating port. In this embodiment, the signal lines 51*a* of the cable 2*a* are supplied with low-speed signals.

Figure 14:
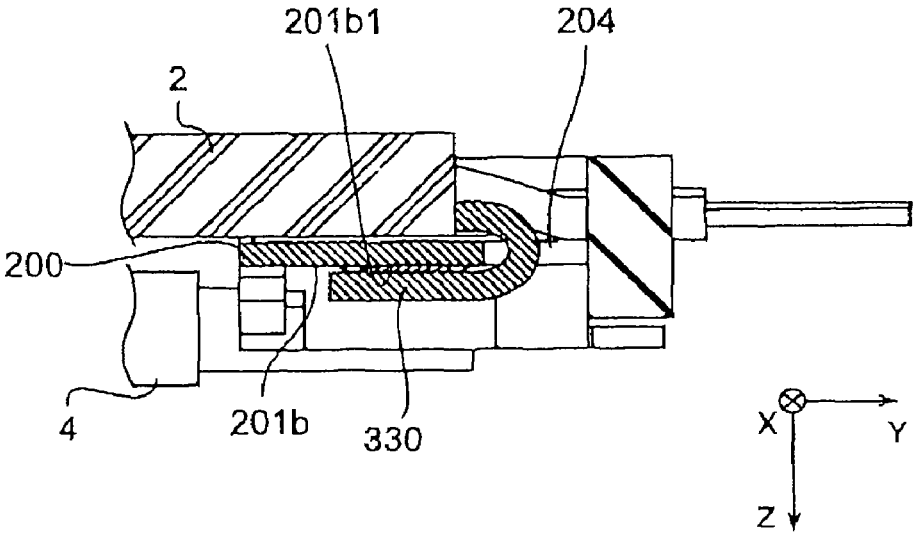
FIG. 14 is a cross-sectional view of the state of FIG. 12, taken along lines XIV-XIV, wherein a drain line of the cable is connected with a drain connection portion.

With reference to FIGS. 13 and 14, each of the drain lines 330 is routed from the cable 2 or 2*a* to a drain connection portion (a second drain connection portion) 201*b*1 of the second surface 201*b* through the corresponding notch 204. As shown in FIG. 14, the drain line 330 is connected with the drain connection portion 201*b*1 by soldering. With reference to FIGS. 1, 2 and 13, the drain line 330 is connected with the ground contact 12*b* through the contact portion 202. Similarly to the first ground plate 100, the drain line 330 is positioned under the cable 2 in the Z-direction and positioned between a pair of signal lines 310 in the X-direction. In other words, the signal lines 310 are located to be symmetric with respect to the drain line 330 in the X-direction. Because of the symmetrical arrangement, for a pair of the signal lines 310, a distance between the drain line 330 and one of the signal lines 310 is equal to a distance between the drain line 330 and the other signal line 310. As the result, an impedance of the cable 2 is suitably matched with another impedance of the connector. In addition, the drain connection portion 201*b*1, i.e. the connection between the drain line 330 and the second ground plate 200 is not positioned on the same surface on which the signal cable 300 is positioned. In other words, the signal cable 300 and the drain connection portion 201*b*1 are positioned on different surfaces, i.e. the first surface 201*a* and the second surface 201*b*. The position of the drain connection portion 201*b*1 makes a size of the connector of this embodiment smaller than in comparison with the conventional connector.

With reference to FIGS. 11 and 13, the connection member 280 is attached to the second holder 250 so that the press-fitted portions 284 are pressed into the pres-fit portions 221, respectively, and that the connection portion 282 is held by the hold portion 260. The power supply cable 4 is soldered to the connection portion 282 and is connected with the power supply contact 13*b* (See FIG. 1) through the contact portion 286 of the connection member 280.

Figure 15:
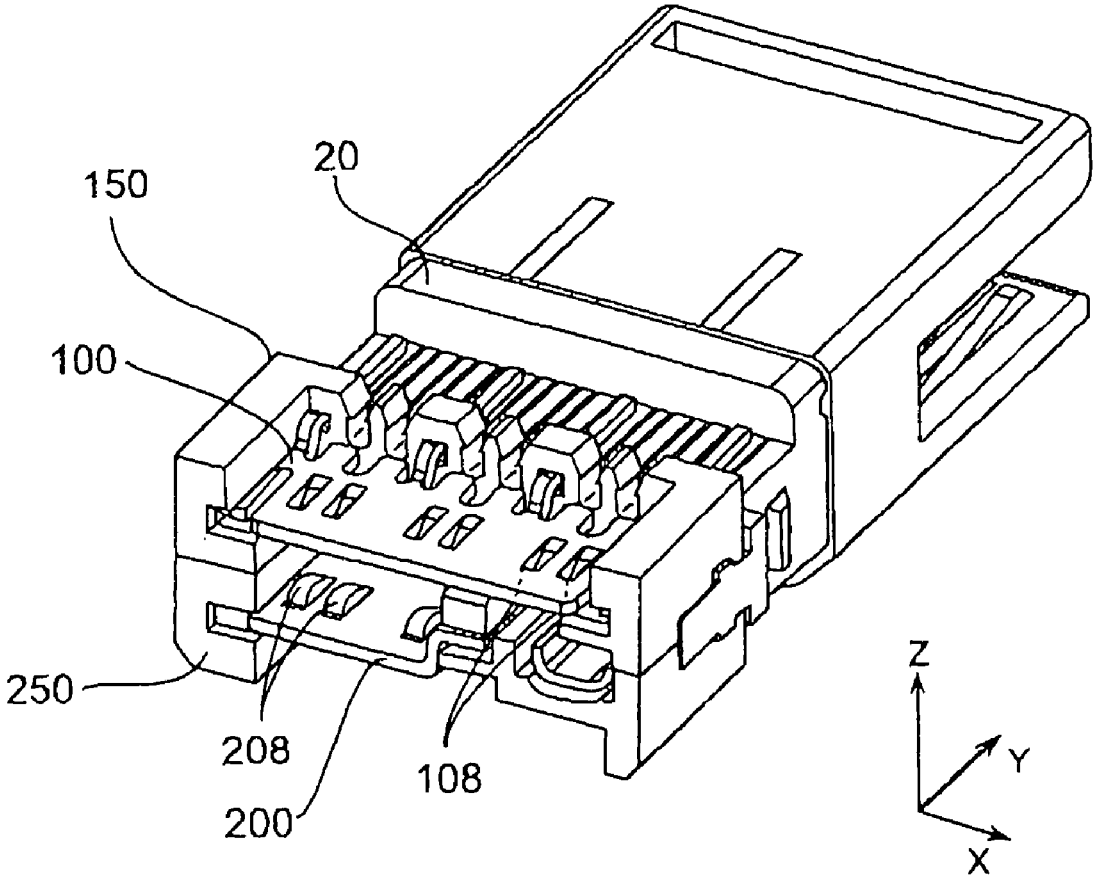
FIG. 15 is a perspective view of the connector of FIG. 3, wherein the connector is in an assembled state, and the cables are not shown.

With reference to FIGS. 15 and 16, the first holder 150 with the first ground plate 100 and the second holder 250 with the second ground plate 200 are attached to the locator 20 so that the projections 108 project downward, while the projections 208 project upward. In other words, the drain connection portions 101*b*1 of the first ground plate 100 face the second ground plate 200, while, the drain connection portions 201*b*1 of the second ground plate 200 face the first ground plate 100. In FIG. 15, the cables are not shown. As apparent from FIGS. 7, 12 and 16, the contact portions 102, 202 and 286 and the signal lines 310, 51*a* and 51 of the cable 2, 2*a* and 5 are arranged and supported by the first holder 150 and the second holder 250 so that the contact portions 102, 202 and 286 and the signal lines 310, 51*a* and 51 are positioned on the respective contacts 10 when the first holder 150 and the second holder 250 are attached to the locator 20. The contact portion 102, 202 and 286 and the signal lines 310, 51*a* and 51 may be connected to the respective contacts 10 by a pales-heat soldering or the like.

The present application is based on a Japanese patent application of JP 2008-213727 filed before the Japan Patent Office on Aug. 22, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to be connected with a cable including a drain line, comprising:

a plurality of ground contacts;

a housing holding the ground contacts; and a ground plate connected with the ground contacts, the ground plate having a first surface and a second surface and provided with a drain connection portion, the first surface being configured so that the cable is mounted on the first surface, the second surface being a back of the first surface, the drain connection portion being configured to be connected with the drain line and being formed on the second surface.

2. The connector according to claim 1, the cable further including a signal line, wherein the connector further comprises: a plurality of signal contacts connected with the signal lines; and a locator which locates the signal contacts and the ground contacts in a width direction of the connector.

3. The connector according to claim 2, wherein a pair of the signal contacts is positioned between neighboring ones of the ground contacts.

4. The connector according to claim 1, further comprising a holder holding the ground plate, the holder being provided with a hold portion holding the signal line.

5. The connector according to claim 4, wherein the ground plate is provided with an engagement portion, the holder comprising an engaged hole, the engagement portion being engaged with the engaged hole so that the ground plate is fixed to the holder.

6. The connector according to claim 1, wherein the ground plate has an edge, the edge being formed with a notch through which the drain line is routed from the cable to the drain connection portion and is connected to the drain connection portion.

7. The connector according to claim 1, wherein the ground plate is provided with a pair of projections, the pair of projections being formed on the second surface of the ground plate so that the drain connection portion is positioned between the projections in the width direction.

8. The connector according to claim 4, wherein the holder comprises a first holder and a second holder, the ground plate comprising a first ground plate and a second ground plate, the first holder and the second holder holding the first ground plate and the second ground plate, respectively.

9. The connector according to claim 8, wherein the drain connection portion comprises a first drain connection portion and a second drain connection portion, the first drain connection portion and the second drain connection portion being provided on the first ground plate and the second ground plate, respectively, the first drain connection portion facing the second ground plate, the second drain connection portion facing the first ground plate.

* * * * *